US008763511B2

(12) United States Patent
Schvartz et al.

(10) Patent No.: US 8,763,511 B2
(45) Date of Patent: Jul. 1, 2014

(54) AMMUNITION MAGAZINE AND LOADING DEVICE THEREOF

(75) Inventors: Adolf Schvartz, Haifa (IL); Avner Koren, Manof (IL); Shlomo Alkaher, Haifa (IL)

(73) Assignee: Elbit Systems Ltd., Haifa (IL)

( * ) Notice: Subject to any disclaimer, the term of this patent is extended or adjusted under 35 U.S.C. 154(b) by 0 days.

(21) Appl. No.: 13/580,253

(22) PCT Filed: Feb. 21, 2011

(86) PCT No.: PCT/IL2011/000174

§ 371 (c)(1),
(2), (4) Date: Sep. 12, 2012

(87) PCT Pub. No.: WO2011/101853

PCT Pub. Date: Aug. 25, 2011

(65) Prior Publication Data

US 2013/0000473 A1 Jan. 3, 2013

(30) Foreign Application Priority Data

Feb. 21, 2010 (IL) ..... 204088

(51) Int. Cl.
*F41A 9/80* (2006.01)

(52) U.S. Cl.
USPC ..... 89/33.2; 89/33.14

(58) Field of Classification Search
CPC ..... F41A 9/00; F41A 9/29; F41A 9/32; F41A 9/34; F41A 9/61; F41A 9/63; F41A 9/79; F41A 9/80; F41A 9/86
USPC ..... 89/33.01, 33.02, 33.03, 33.04, 33.1, 89/33.14, 33.2, 33.5, 34, 35.01
See application file for complete search history.

(56) References Cited

U.S. PATENT DOCUMENTS

| | | | | | |
|---|---|---|---|---|---|
| 1,719,147 | A | * | 7/1929 | Tansley | 89/33.14 |
| 1,901,868 | A | * | 3/1933 | Dabrasky | 89/33.16 |
| 2,398,263 | A | * | 4/1946 | Trimbach | 89/34 |
| 2,470,475 | A | * | 5/1949 | Diaper | 89/34 |
| 2,494,728 | A | * | 1/1950 | Stacey et al. | 89/33.16 |
| 2,573,774 | A | * | 11/1951 | Sandberg | 89/34 |
| 2,889,751 | A | * | 6/1959 | Bilek | 89/34 |

(Continued)

FOREIGN PATENT DOCUMENTS

GB 554714 7/1943

*Primary Examiner* — Bret Hayes
*Assistant Examiner* — Derrick Morgan
(74) *Attorney, Agent, or Firm* — Shalom Wertsberger; Saltamar Innovations

(57) ABSTRACT

An ammunition magazine (20) contains an ammunition belt (34) of linked ammunition cartridges (36) to be fed into a machine gun (12), the magazine (20) including a front opening (26'), enabling a leading end of the ammunition belt (34) to be accessible for feeding the machine gun (12) and for linking with a trailing end of another ammunition belt (34), and a rear opening (26"), enabling a trailing end of the ammunition belt (34) to be accessible for linking with a leading end of another ammunition belt (34). An arrangement of consecutive and adjacent ammunition magazines (20) allows movement of an ammunition belt (34) from the distal magazine (**20*b*) into the proximal magazine (20*a*) towards the machine gun (12) during operation, enabling continuous feeding of ammunition belts (34) into the machine gun. An ammunition loading system for conveying ammunition between a magazine platform and a hull region, including a lifting mechanism (24**) to lift an ammunition magazine into the magazine platform from the hull region.

23 Claims, 7 Drawing Sheets

(56) References Cited

U.S. PATENT DOCUMENTS

| | | | | | |
|---|---|---|---|---|---|
| 3,246,565 | A | * | 4/1966 | Ramseyer | 89/33.14 |
| 3,333,507 | A | * | 8/1967 | De Meiss Rene | 89/36.13 |
| 4,393,746 | A | * | 7/1983 | Rocha | 89/34 |
| 4,433,609 | A | * | 2/1984 | Darnall | 89/34 |
| 4,466,333 | A | | 8/1984 | Kaustrater | |
| 4,494,440 | A | * | 1/1985 | Koine | 89/33.04 |
| 4,593,600 | A | * | 6/1986 | Kaustrater | 89/33.1 |
| 4,662,264 | A | * | 5/1987 | Kaustrater | 89/33.1 |
| 4,667,565 | A | * | 5/1987 | Anderson | 89/36.08 |
| 4,972,758 | A | * | 11/1990 | Austin et al. | 89/34 |
| 4,974,490 | A | * | 12/1990 | Austin | 89/34 |
| 5,245,908 | A | * | 9/1993 | Sanderson | 89/34 |
| 5,253,574 | A | * | 10/1993 | Sanderson | 89/34 |
| 5,263,397 | A | * | 11/1993 | Sanderson | 89/37.22 |
| 5,282,410 | A | * | 2/1994 | Sanderson | 89/37.16 |
| 6,009,791 | A | * | 1/2000 | Medlin | 89/38 |
| 6,164,180 | A | * | 12/2000 | Sulm et al. | 89/33.16 |
| 6,439,098 | B1 | * | 8/2002 | Dillon | 89/34 |
| 6,622,606 | B1 | * | 9/2003 | Neal | 89/33.01 |
| 7,913,610 | B2 | * | 3/2011 | Ulveraker et al. | 89/33.14 |
| 8,215,225 | B1 | * | 7/2012 | Zangrando et al. | 89/46 |
| 2012/0137863 | A1 | * | 6/2012 | Buechler et al. | 89/33.14 |

* cited by examiner

AMMUNITION MAGAZINE AND LOADING DEVICE THEREOF

FIELD OF THE DISCLOSED TECHNIQUE

The disclosed technique relates to the field of belt-fed ammunition, in general, and to an ammunition magazine and an ammunition loading system and method, in particular.

BACKGROUND OF THE DISCLOSED TECHNIQUE

Remotely controlled weapon systems may be mounted on armored vehicles. A remotely-controlled weapon system is typically mounted on a rotatable turret that is positioned on the roof of a carrier vehicle. The system is typically controlled from within the vehicle or from a remote location. The remote control of the weapon system may include remotely controlling the rotation of the turret, raising or lowering the weapon on the turret, and activating the weapon. An optical system may be provided to facilitate viewing targets. In many cases the optical system is aligned with the weapon, such that it is directed in the same direction as that in which the weapon is aimed.

For quick reloading, small and medium caliber ammunition is usually provided in the form of an ammunition belt of linked cartridges that is fed into the barrel of the gun. Commonly, ammunition belts are stored in a container adjacent to the gun for convenient loading. Additional ammunition may be stored inside the carrier vehicle. Ammunition belts are sometimes provided in magazines.

When a belt of ammunition has been fully used up, it is necessary to feed the gun with a new belt of ammunition, sometimes under battlefield conditions. It is desirable to carry out this operation as quickly as possible in order to maximize the time that the gun is available for use and to minimize the exposure of personnel to enemy fire. Personnel manning the vehicle should preferably not have to leave the interior of the armored vehicle or expose themselves to the exterior of the vehicle.

Under battlefield conditions, the turret may be rotated at frequent intervals in order to aim the gun at various targets on the battlefield. Attempting to load an ammunition belt or a magazine into the turret while the turret is rotating may lead to damage incurred to the turret or to the ammunition, or may lead to injuring personnel manning the turret.

U.S. Pat. No. 3,333,507, entitled "Armored vehicles including a turret fitted with an automatic gun fed from cartridge belt sections packed in boxes", discloses an armored vehicle having a rotatable turret and an automatic gun fed from cartridge belts which are packed in ammunition boxes. The armored vehicle includes an armored body, a rotatable turret, which is mounted on a roller track and is fitted with an automatic gun, and a feed mechanism for feeding the automatic gun with cartridge belt sections packed in ammunition boxes. The armored vehicle further includes an ammunition box guide, means for storing the ammunition boxes in the vehicle, means for maintaining the ammunition boxes in a position, and means to enable the removal of empty ammunition boxes. The ammunition box guide includes inclined rails and is adapted to slidably transfer at least two ammunition boxes, positioned behind one another, one in a waiting position and the other in a firing position, to the automatic gun for firing. The ammunition boxes are stored in a storing position and are engaged against the ammunition box guide by an operator of the vehicle. The operator further engages the cartridge belt section which is in the firing position into the feed mechanism, and secures the front end of the cartridge belt section in the waiting position to the preceding belt section which is already engaged in the feeding mechanism.

U.S. Pat. No. 4,466,333, entitled "Armored vehicle", discloses an armored vehicle having a rotatable turret and a gun carrier mounted thereon. The vehicle further includes an armored body in which an opening is defined and a conveyor. A container reloading station is positioned at a horizontal slideway within the armored body. A container receiving position is positioned on the gun carrier, and is aligned with the container reloading station through the opening. The conveyor conveys magazine containers loaded with belted or unbelted cartridges, for firing, or empty containers for replacement. The magazine containers are conveyed between the reloading station and the receiving position through the opening when the turret and the gun carrier are set on an indexed position.

SUMMARY OF THE DISCLOSED TECHNIQUE

In accordance with an aspect of the disclosed technique, there is thus provided an ammunition magazine containing an ammunition belt of a plurality of linked ammunition cartridges to be fed into a machine gun. The ammunition magazine includes a front opening and a rear opening respective of the machine gun. The front opening enables a leading end of the ammunition belt to be accessible for continuous feeding of the machine gun and for linking with a trailing end of another ammunition belt. The rear opening enables a trailing end of the ammunition belt to be accessible for linking with a leading end of another ammunition belt. The ammunition magazine may include two ledges. Each of the ledges projects internally from a respective side of the ammunition magazine, for supporting selected cartridges of the ammunition cartridges. The ammunition belt is folded vertically inside the ammunition magazine, and the folded portions of the ammunition belt are hanging from and supported by the selected cartridges.

In accordance with another aspect of the disclosed technique, there is further provided an arrangement of at least two of the ammunition magazines disposed in a magazine platform. The ammunition magazines are consecutively and adjacently arranged with respect to the machine gun to allow consecutive feeding of the contained ammunition belts into the machine gun. The front side of a distal ammunition magazine of the at least two ammunition magazines, which is positioned distally with respect to the machine gun, is placed next to the rear side of a proximal ammunition magazine of the at least two ammunition magazines, which is positioned proximally with respect to the machine gun, such that the leading end of the ammunition belt contained in the distal ammunition magazine is linked with the trailing end of the ammunition magazine contained in the proximal ammunition magazine. Each of the ammunition magazines in the arrangement may include two ledges. Each of the ledges project internally from a respective side of each ammunition magazine, for supporting selected cartridges of each respective ammunition cartridges. Each respective ammunition belt is folded vertically inside each ammunition magazine. The folded portions of each respective belt are hanging from and supported by each respective selected cartridges. The ammunition magazines are further arranged such that the ledges of the proximal magazine and of the distal magazine are aligned to form continuous rails allowing a substantially smooth movement of the ammunition belt, contained in the distal magazine, into the proximal magazine.

In accordance with a further aspect of the disclosed technique, there is thus provided an ammunition loading system for conveying ammunition between a magazine platform and a hull region. The hull region is located beneath the magazine platform, to be used with at least one ammunition magazine. The ammunition loading system includes a lifting mechanism, operable for lifting the at least one ammunition magazine into the magazine platform from the hull region for loading the at least one ammunition belt into the machine gun. The lifting mechanism of the ammunition loading system may include an elevator. The elevator includes a lifting platform operable to be raised and lowered along a vertical track. The at least one ammunition magazine is being placed onto the lifting platform. The elevator may be operable for lowering the at least one ammunition magazine into the hull region from the magazine platform, to allow replacement of the at least one ammunition magazine after it is used.

In accordance with yet a further aspect of the disclosed technique, there is further provided a method for feeding ammunition belts into a machine gun. Each of the ammunition belts includes a plurality of linked ammunition cartridges. The method includes the procedure of providing a plurality of ammunition magazines. Each ammunition magazine is operative for containing a respective one of the ammunition belts. Each of the ammunition magazines includes a front opening and a rear opening respective to the machine gun. The front opening enables a leading end of the contained ammunition belt to be accessible for continuous feeding of the machine gun and for linking with a trailing end of another of the ammunition belts. The rear opening enables a trailing end of the contained ammunition belt to be accessible for linking with a leading end of another of the ammunition belts. The method further includes the procedures of loading the leading end of a first of the ammunition belts contained in a first respective one of the ammunition magazines into the machine gun and of linking the trailing end of the first ammunition belt contained in the first ammunition magazine with the leading end of a second of the ammunition belts contained in a second respective one of the ammunition magazines. The procedure of providing may include providing at least one of the plurality of ammunition magazines with two ledges internally projecting from each respective side of the at least one ammunition magazine, for supporting selected cartridges of the respective ammunition cartridges. The respective contained ammunition belt is folded vertically inside the ammunition magazine. The folded portions of the respective belt are hanging from and supported by the selected cartridges. The method may further include the procedure of placing at least one of the plurality of ammunition magazines containing one of the ammunition belts in a magazine platform. The method may further include the procedure of arranging at least two ammunition magazines of the plurality of ammunition magazines, which are disposed in a magazine platform, in a consecutive and adjacent manner with respect to the machine gun, such that the front side of the distal magazine is positioned next to the rear side of the proximal magazine. The procedure of arranging may include aligning the at least two ammunition magazines. Each of the at least two ammunition magazines further includes two ledges internally projecting from each respective side of each of the ammunition magazines, for supporting selected cartridges of each of the respective ammunition cartridges. Each respective ammunition belt is folded vertically inside each respective ammunition magazine. The folded portions of each respective ammunition belt are hanging from and supported by the respective selected cartridges, such that the ledges of the at least two ammunition magazines are aligned to effectively form two continuous rails allowing a substantially smooth movement of the ammunition belt, contained in the distal magazine, into the proximal magazine. The method may further include the procedure of removing at least one of the plurality of ammunition magazines disposed in a magazine platform after the ammunition magazine is emptied from the contained ammunition belt by the operation of the machine gun. The method may further include the procedure of replacing at least one of the plurality of ammunition magazines, disposed in a magazine platform, after the ammunition magazine is emptied from the contained ammunition belt, with one of the plurality of ammunition magazines, which contains an unused one of the ammunition belts. The method may further include the procedure of linking a leading end of a distal ammunition belt of the plurality of ammunition belts, contained in a respective distal ammunition magazine of the ammunition magazines, which is positioned distally with respect to the machine gun, with a trailing end of a proximal ammunition belt of the ammunition belts, contained in a respective proximal ammunition magazine of the ammunition magazines, which is positioned proximally with respect to the machine gun. The method may further include the procedure of hanging each of the ammunition belts over two ledges internally projecting from each respective side of the plurality of ammunition magazine. The procedure of hanging includes supporting selected cartridges of the ammunition belt over the ledges and folding the ammunition belt vertically inside its respective ammunition magazine, such that the folded portions of the respective belt are hanging from and supported by the selected cartridges.

In accordance with yet another aspect of the disclosed technique, there is further provided a method for feeding ammunition belts into a machine gun. Each of the ammunition belts includes a plurality of linked ammunition cartridges. Each of the ammunition belts is contained in a respective ammunition magazine of a plurality of ammunition magazines. The method includes the procedures of loading into the machine gun a leading end of a first ammunition belt of the ammunition belts through a front opening disposed in a respective first ammunition magazine of the plurality of ammunition magazines and linking the trailing end of the first ammunition belt through a rear opening disposed in the respective first ammunition magazine with the leading end of a second ammunition belt of the ammunition belts through a front opening disposed in a respective second ammunition magazine of the plurality of ammunition magazines. The method may further include the procedure of linking the trailing end of a proximal ammunition belt of the ammunition belts through a rear opening disposed in a respective proximal ammunition magazine, with the leading end of a distal ammunition belt of the ammunition belts through a front opening disposed in a respective distal ammunition magazine of the plurality of ammunition magazines.

BRIEF DESCRIPTION OF THE DRAWINGS

The disclosed technique will be understood and appreciated more fully from the following detailed description taken in conjunction with the drawings. It should be noted that the figures are provided as examples only and in no way limit the scope of the disclosed technique. Like components are denoted by like reference numerals.

DETAILED DESCRIPTION OF THE EMBODIMENTS

Figure 1:
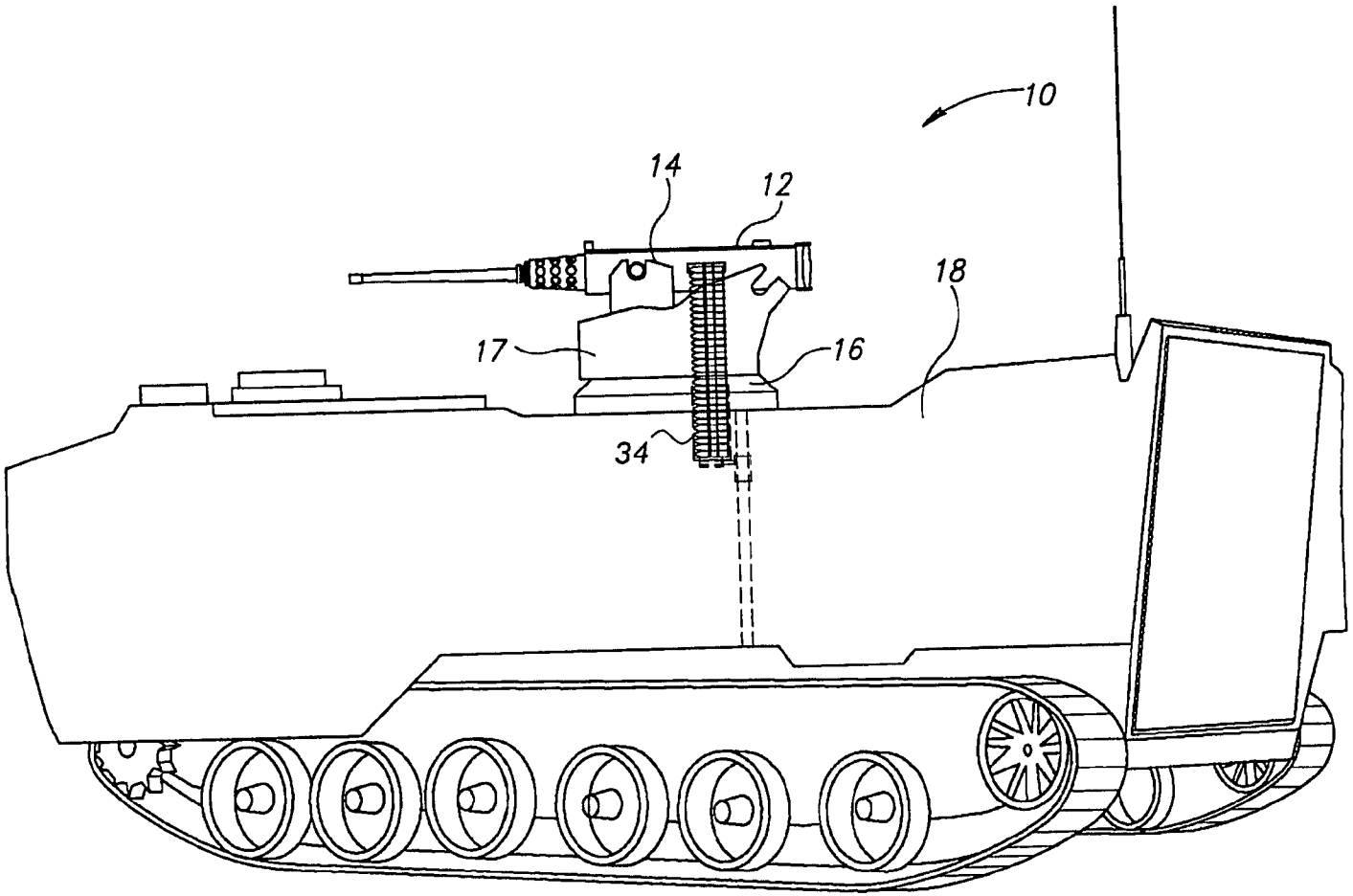
FIG. 1 is a side view schematic illustration of a combat land vehicle with a remotely controlled gun turret, constructed and operative in accordance with an embodiment of the disclosed technique.

The disclosed technique overcomes the disadvantages of the prior art by providing an ammunition loading system and a method for feeding of ammunition belts into a machine gun for a combat vehicle or a stationary post, designed to limit the exposure of personnel to the outside of the vehicle or the stationary post and associated combat risks. The ammunition loading system and the method for feeding ammunition belts into a machine gun enable quick, modular and safe loading and reloading of ammunition magazines to a remotely controlled gun mounted on a turret on the roof of the combat vehicle or of the stationary post. The ammunition loading system is automated or semi-automated, in order to reduce human involvement in the loading process. The disclosed technique further overcomes the disadvantages of the prior art by providing an ammunition magazine which is designed to allow convenient linking of a contained ammunition belt with other ammunition belts and facilitates the continuous feeding and firing and the quick and safe reloading of a machine gun. The design of the ammunition magazine further allows forming various modular arrangements of such ammunition magazines, which facilitate various configurations of the continuous feeding and reloading of the machine gun.

The ammunition magazine is designed to contain ammunition chained in a belt and is formed to allow easy and continuous dispensing of the belt and any ammunition belt linked therewith. The ammunition magazine is designed to facilitate dispensing of the ammunition belt it contains and any ammunition belt linked therewith to an adjacent firearm, and to allow linking of a trailing end of the ammunition belt to a leading end of a matching ammunition belt contained, for example, in an identical or similar ammunition magazine. Thus a continuous ammunition belt may be formed, which may be conveniently delivered to an adjacent firearm, facilitating continuous firing.

The term "ammunition belt" as used herein encompasses an ammunition belt which includes a plurality of segments of ammunition belts linked with one another to form a single continuous ammunition belt. The term "linked" as used herein with regard to ammunition belts encompasses ammunition belts which are linked directly or indirectly, e.g., by using linking fixtures or by using at least another ammunition belt linked therebetween.

The term "machine gun" as used herein encompasses all types of firearms or projectile weaponry operative with belt-fed ammunition, generally via an ammunition belt housed in an ammunition magazine. The terms "machine gun" and "gun" are used interchangeably herein.

The term "combat vehicle" as used herein encompasses all types of vehicles which are armed with a firearm, including land vehicles, aerial vehicles or marine vehicles, generally relating to armoured personnel carriers, such as tanks, or mechanized infantry fighting vehicles, but also including helicopters, battleships, and other vehicles that are typically utilized in a military context. The terms "combat vehicle" and "vehicle" are used interchangeably herein.

The term "hull" or "hull region" as used herein encompasses any region of a combat vehicle, which provides protection for personnel manning the vehicle from combat dangers external to the combat vehicle, including secured premises of the combat vehicle.

The term "automatically", as used herein with regard to the manner of execution of operations or procedures in accordance with embodiments of the disclosed technique, encompasses a semi-automated execution and an execution which is controlled by the operator or which is operator-independent (i.e., without the intervention of the operator).

The term "operator", as used herein, encompasses an operator of a machine gun or an operator of a vehicle in accordance with the disclosed technique or any personnel manning such vehicle. Reference is now made to FIG. 1, which is a side view schematic illustration of a combat land vehicle, generally referenced 10, with a remotely controlled gun turret, constructed and operative in accordance with an embodiment of the disclosed technique. Rotatable turret 17 is mounted atop hull 18 of land vehicle 10. A magazine compartment 16 of land vehicle 10 is located in rotatable turret 17. Gun 12 is mounted on remotely-controlled gun mount 14. Typically, the elevation angle of gun 12 is adjustable through operation of gun mount 14. The rotation angle of gun 12 is adjustable through the rotation of rotatable turret 17. The operation of gun mount 14, the rotation of rotatable turret 17, and the elevation angle and firing of gun 12 is controllable from inside land vehicle 10, or from a remote location (i.e., at some distance from land vehicle 10).

Figure 2A:
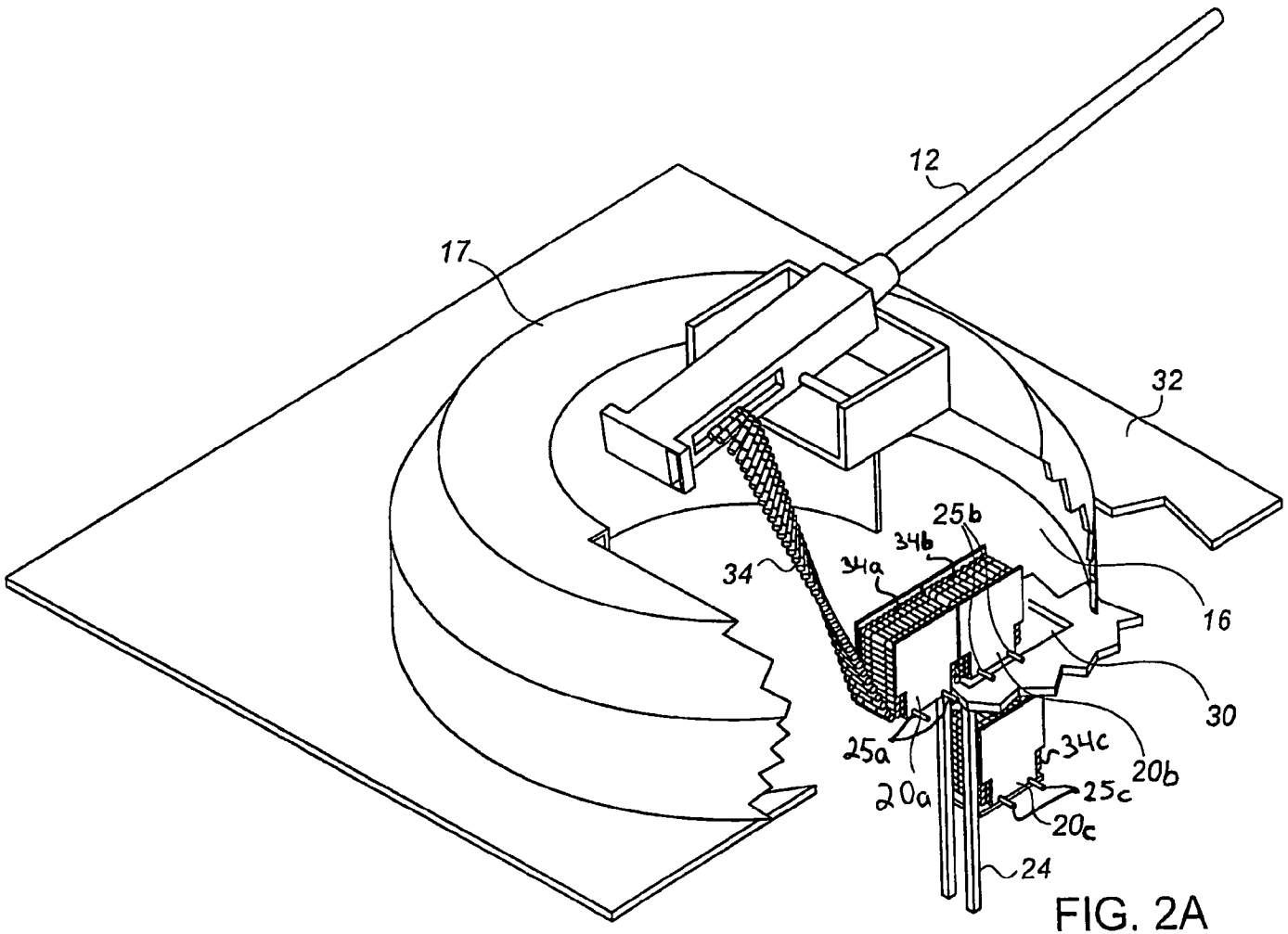
FIG. 2A is a top perspective schematic illustration of an ammunition loading system, constructed and operative in accordance with an embodiment of the disclosed technique.
Figure 2B:
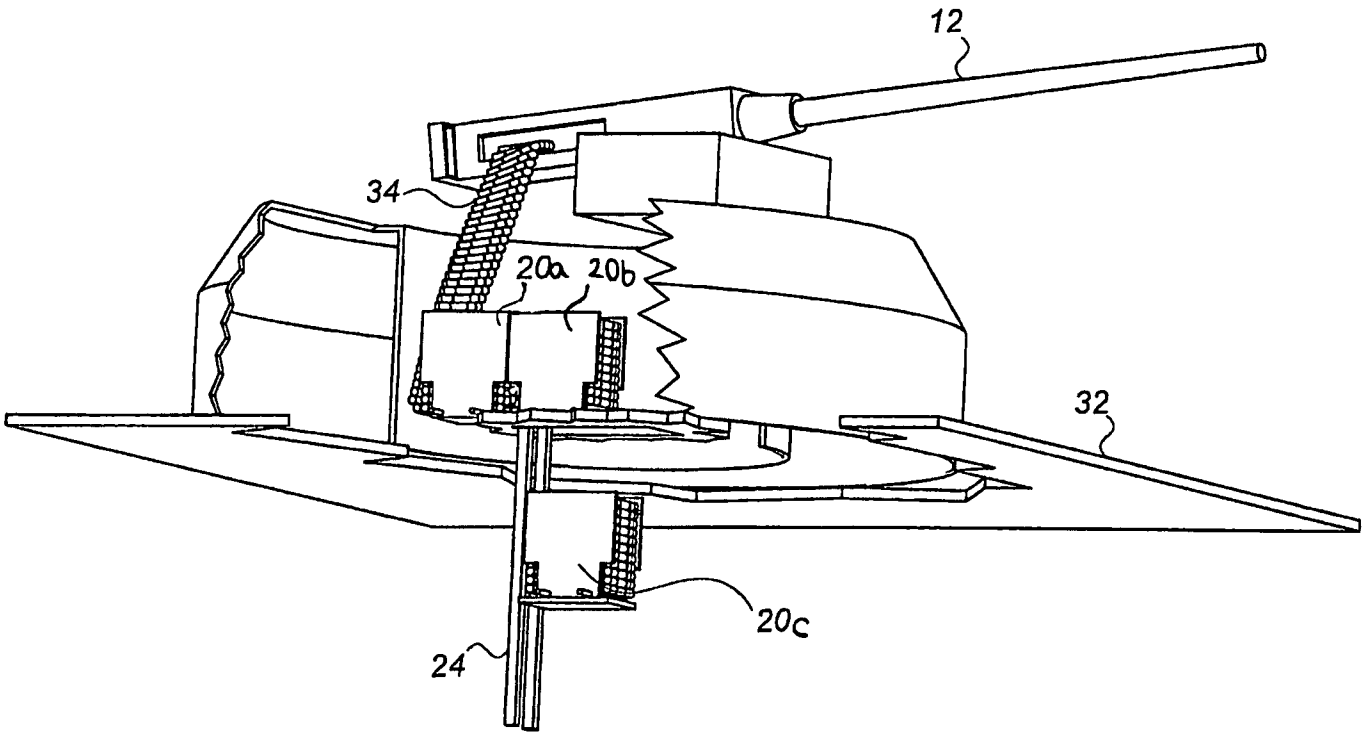
FIG. 2B is a side perspective schematic illustration of the ammunition loading system of FIG. 2A.

Reference is now made to FIG. 2A and FIG. 2B. FIG. 2A is a top perspective schematic illustration of an ammunition loading system, constructed and operative in accordance with an embodiment of the disclosed technique. FIG. 2B is a side perspective schematic illustration of the ammunition loading system of FIG. 2A. The ammunition loading system may be installed in a combat vehicle which include a top mounted machine gun (e.g., gun 12). Ammunition is fed into gun 12 by an ammunition belt 34. Ammunition belt 34 includes a chain of individual ammunition cartridges 36 (shown in FIG. 3). A supply of unused ammunition belts 34 is stored at a location inside the vehicle. Gun 12 pulls on belt 34 as gun 12 is operated. Ammunition belt 34 is contained in one or more ammunition magazines 20 until ammunition belt 34 is removed by an action of gun 12 or by a person loading gun 12. Ammunition belt 34 may be consisted of a plurality of ammunition belt segments (e.g., belt segment 34*a*, belt segment 34*b* and belt segment 34*c*), each segment contained within a respective ammunition magazine 20 (e.g., magazine 20*a*, magazine 20*b* and magazine 20*c*, accordingly) and consecutively linked with one another (e.g., belt segment 34*a* is linked with belt segment 34*b*). In order for the ammunition in ammunition magazine 20 to be available for use by gun 12, ammunition magazine 20 is loaded into a magazine compartment 16. Magazine compartment 16 is located in rotatable turret 17. Thus, magazine compartment 16 may rotate in unison with rotatable turret 17. Magazine compartment 16 is designed to hold or retain ammunition magazines 20 including ammunition belts, which are to be fed into gun 12.

Magazine compartment 16 may hold one or more ammunition magazines 20 at a given time. Ammunition magazine 20 may include extendible support pins 25. When ammunition magazine 20 is placed in magazine compartment 16, support pins 25 may be extended to engage a support structure (not shown) in magazine compartment 16. The support structure may enable more than one ammunition magazines 20 to be stored in magazine compartment 16. When more than one ammunition magazine 20 is loaded into magazine compartment 16, the ends of the ammunition belts in adjacent ammunition magazines 20 may be linked with one another. During operation of gun 12, ammunition belt segment 34*a* is pulled completely out of one ammunition magazine 20*a*, emptying ammunition magazine 20*a* from ammunition belt segment 34*a*. At that point, gun 12 continues to pull ammunition belt segment 34*b*, linked with belt segment 34*a*, from an adjacent ammunition magazine 20*b*. In this manner, gun 12 continues to operate and utilize all ammunition belt segments 34 from all ammunition magazines 20 that are loaded into magazine compartment 16.

When an ammunition magazine 20*a* or 20*b* is emptied, or when the amount of ammunition available to gun 12 is to be increased, another ammunition magazine 20*c* may be loaded into magazine compartment 16. Typically, a full magazine (i.e., containing an ammunition belt segment) is stored within hull 18 of the vehicle (e.g., combat land vehicle 10 of FIG. 1). Ammunition magazine 20*c* is lifted up to magazine compartment 16 through hatch 30 in roof 32 of the vehicle via an elevator 24. It is understood that alternative methods of transporting ammunition magazine 20*c* may be employed in conjunction with the disclosed technique. Hatch 30 is located above elevator 24. Hatch 30 is of such size and shape that magazine 20*c*, when lifted by elevator 24, can pass vertically through hatch 30. When magazine 20*c* is lifted to a predetermined height, such as the height occupied by ammunition magazines 20*a* and 20*b*, pins 25*c* of ammunition magazine 20*c* are made to engage magazine compartment 16. Pins 25 are operated manually, for example, by an operator reaching upward through hatch 30 to operate a mechanical mechanism for extending pins 25. Alternatively, pins 25 are operated through any other mechanism known in the art, such as, for example, an electromechanical or hydraulic pin extension mechanism. It should be noted that the relative locations of ammunition magazines 20*a* and 20*b* and ammunition magazine 20*c* in FIGS. 2A and 2B are illustrative only. Typically, ammunition magazine 20*c* would not be lifted by elevator 24 when another ammunition magazine 20*b* blocks hatch 30, as is shown. Ammunition magazine 20 may include an alternative type of engagement fixture adapted to engage a supporting structure of retaining means installed in the vehicle, other than, or in addition to, extending pins 25. For example, the engagement fixture may be embodied by one or more tabs, rods, arms, or similar extensions that extend from ammunition magazine 20 to a corresponding groove, ledge, tab or similar retaining means installed on magazine compartment 16 of combat land vehicle 10 that is configured to support the extension. Alternatively, pins or other extensions may extend from walls or other portions of magazine compartment 16 to a corresponding structure disposed on ammunition magazine 20. Further alternatively, the bottom of magazine compartment 16 may include a floor, rails, or another structure adapted for retaining and supporting an ammunition magazine. The floor may be provided with one or more openings through which an ammunition magazine may be lifted when the opening aligns with hatch 30.

Figure 3:
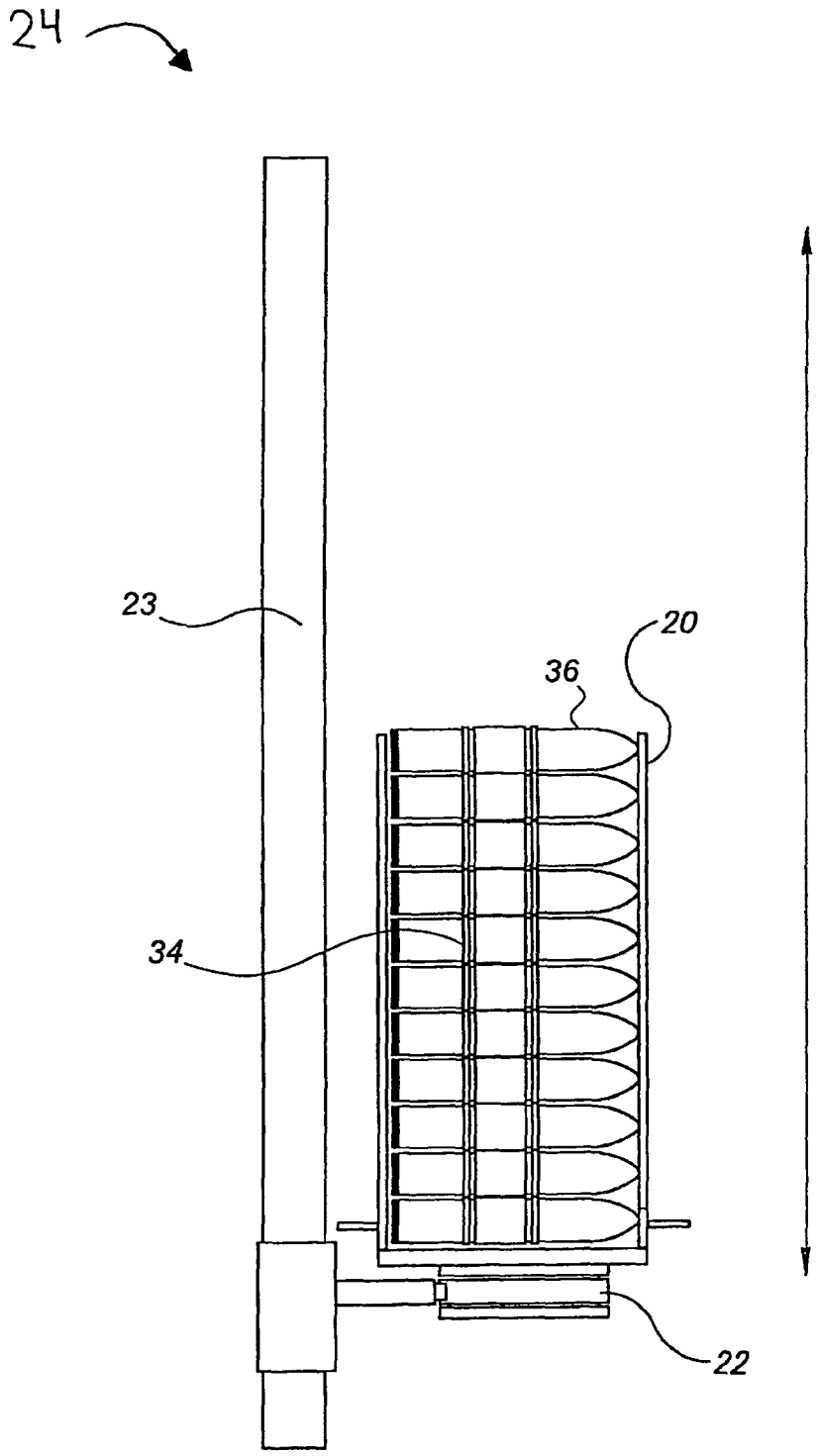
FIG. 3 is a detailed view schematic illustration of the elevator of the ammunition loading system of FIGS. 2A and 2B.

Reference is now made to FIG. 3, which is a detailed view of the elevator of the ammunition loading system of FIGS. 2A and 2B. Elevator 24 includes a vertical track 23 and a lifting platform 22. Lifting platform 22 projects outwards horizontally from vertical track 23. For example, lifting platform 22 is mounted on a support arm that extends outward perpendicular to vertical track 23. Lifting platform 22 is of sufficient size and shape to support an ammunition magazine. Elevator 24 is operated by moving lifting platform 22 up and down along vertical track 23. Lifting platform 22 may be moved along vertical track 23 by means of an electric motor, or alternatively, by a hydraulic, mechanical, electromagnetic, or any other suitable mechanism known in the art for operating an elevator.

Lifting platform 22 can be lowered to a lowered position within a hull region of a vehicle (e.g., hull 18 of combat land vehicle 10), in order to allow the placing of an ammunition magazine 20 onto lifting platform 22. A loaded ammunition magazine 20, containing an ammunition belt 34 (or a segment thereof) with ammunition cartridges 36, is placed onto the lowered lifting platform 22 by an individual located inside the hull region. Elevator 24 can then be operated by raising lifting platform 22, thereby moving ammunition magazine 20 upwards from the hull region , e.g., toward hatch 30 in roof 32 of a combat vehicle .

Elevator 24 can cooperate with one or more sensors (not shown) that verify that conditions are suitable for the operation of elevator 24. For example, it may not be advisable to lift ammunition magazine 20 if hatch 30 in roof 32 (FIG. 2A) is closed, e.g., by an optional hatch door. A hatch door may be provided with an appropriate optical, mechanical, electromagnetic, acoustic, or other type of door status sensor, as is known in the art. The sensor may provide a signal that indicates whether or not the hatch door is sufficiently opened in order to enable the passage of ammunition magazine 20 through hatch 30. Alternatively, a control system that controls the hatch door may provide an appropriate signal that indicates the status of the hatch door. Similarly, one or more sensors may be provided to indicate whether magazine compartment 16 (FIG. 2A) is appropriately oriented to enable loading of magazine 20. For example, magazine compartment 16 may be loadable through one or more openings, and only when one of the openings aligns with hatch 30. As another example, magazine compartment 16 may occupy a limited portion of turret 17, or only a limited portion of magazine compartment 16 can be configured to hold ammunition magazine 20. An appropriate mechanical, optical, electromagnetic, acoustic, or other appropriate sensor as is known in the art may sense the orientation of magazine compartment 16. The sensor may provide a signal that indicates whether or not the current orientation of magazine compartment 16 is suitable for loading ammunition magazine 20 through hatch 30. Alternatively, an encoder associated with a turret orientation control system may provide a signal that indicates the orientation of the turret 17 and the associated magazine compartment 16.

Similarly, a sensor may be provided to indicate that a space above hatch, 30 is not currently occupied by an ammunition magazine 20. An appropriate mechanical, optical, electromagnetic, acoustic, or other appropriate sensor as known in the art may be provided. The sensor may provide a signal that indicates whether a space in magazine compartment 16 above hatch 30 is currently occupied by another ammunition magazine 20. In addition, a sensor may be provided to indicate whether lifting platform 22 is currently holding an ammunition magazine 20 such that ammunition magazine 20 extends upward through hatch 30. For example, hatch 30 may be provided with an appropriate optical sensor, or an encoder associated with elevator 24, that may indicate the position of lifting platform 22.

If elevator 24 were to lift ammunition magazine 20 when conditions were not suitable, damage or injury to equipment or personnel could result. For example, components of elevator 24, of ammunition magazine 20, of combat land vehicle 10, or of turret 17, could be subject to damage. Similarly, an operator or other personnel occupying combat land vehicle 10 could be injured. Therefore, elevator 24 may be provided with a control system that cooperates with appropriate sensors to disable operation when conditions are not suitable.

Figure 4:
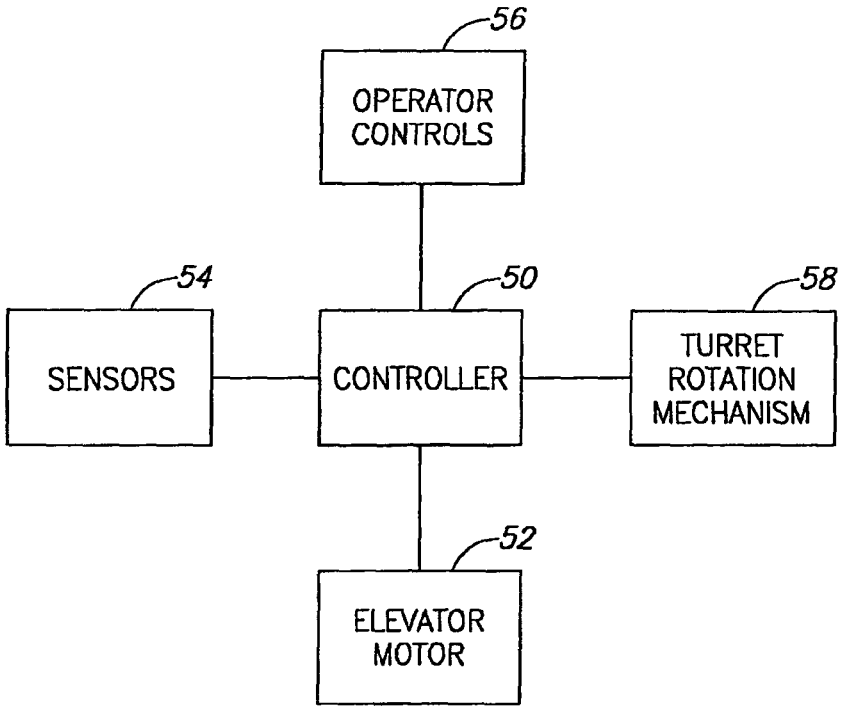
FIG. 4 is a block diagram of the control elements of the ammunition loading system of FIGS. 2A and 2B.

Reference is now made to FIG. 4, which is a block diagram of the control elements of the ammunition loading system of FIGS. 2A and 2B. A controller 50 is coupled with an elevator motor 52, with sensors 54, with operator controls 56, and with a turret rotation mechanism 58. Controller 50 controls the operation of elevator 24. Controller 50 includes at least one analog or digital electronic circuit, programmable electronic processor, or computer. Controller 50 receives an instruction signal from operator controls 56. Operator controls 56 include controls to raise or lower lifting platform 22, and controls to stop the motion of lifting platform 22. Operator controls 56 are typically located near elevator 24, and are accessible to the operator at his position within the hull region. The operation of operator controls 56 causes an appropriate signal to be sent to controller 50.

Controller 50 also receives signals from sensors 54. Sensors 54 may include sensors that indicate whether conditions are appropriate for operation of elevator 24. For example, sensors 54 provide signals that indicate the status of a hatch door in hatch 30, the orientation of magazine compartment 16 relative to the hatch door, the presence of another ammunition magazine in magazine compartment 16, and/or the presence of another ammunition magazine in elevator 24. The operation of elevator 24 may be actively restricted based on the indications of sensors 54. For example, when sensors 54 indicate that conditions are suitable for lifting ammunition magazine 20 up to magazine compartment 16, the lifting action is enabled, and the operation of operator controls 56 to lift lifting platform 22 results in elevator motor 52 raising lifting platform 22. On the other hand, should sensors 54 indicate that conditions are not suitable for lifting ammunition magazine 20 up to magazine compartment 16, the lifting action is disabled, and the operation of operator controls 56 to raise lifting platform 22 does not result in elevator motor 52 raising lifting platform 22. Optionally, controller 50 generates an audible, visible, or other indication that notifies that raising lifting platform 22 has been disabled. Controller 50 may generate an audible, visible, or other indication that indicates which condition or conditions caused raising lifting platform 22 to be disabled.

Controller 50 transmits signals to control elevator 24. Controller 50 may control the operation of elevator motor 52 directly or indirectly. For example, controller 50 may cause elevator motor 52 to raise lifting platform 22, to lower lifting platform 22, to stop the motion of lifting platform 22, or to change the speed at which lifting platform 22 is moving. Controller 50 controls the operation of elevator motor 52 by providing appropriate electric currents to elevator motor 52. Alternatively, controller 50 may generate an appropriate visible, audible, or tactile indicatation to an operator that indicates to the operator how to operate elevator 50.

Optionally, controller 50 controls the operation of turret rotation mechanism 58. Controller 50 directs turret rotation mechanism 58 to rotate turret 17 in either rotation direction, to stop rotation of turret 17, or to change the speed of rotation of turret 17. Controller 50 may control the rotation of turret 17 by providing appropriate electric currents to turret rotation mechanism 58. Alternatively, controller 50 may generate an appropriate visible, audible, or tactile indication to an operator that indicates to the operator how to operate turret 17. The operation of turret rotation mechanism 58 may be actively restricted based on the indications of sensors 54. For example, rotation of turret 17 may be limited when sensors 54 indicate that a raised ammunition magazine 20 extends above hatch 30. Rotation of turret 17 may be limited in such a scenario in order to prevent a collision between the raised ammunition magazine 20 and an opening in turret 17 or another ammunition magazine 20 already in magazine compartment 16. Controller 50 may generate an audible, visible, or other indication that indicates that rotation of turret 17 has been limited.

Figure 5:
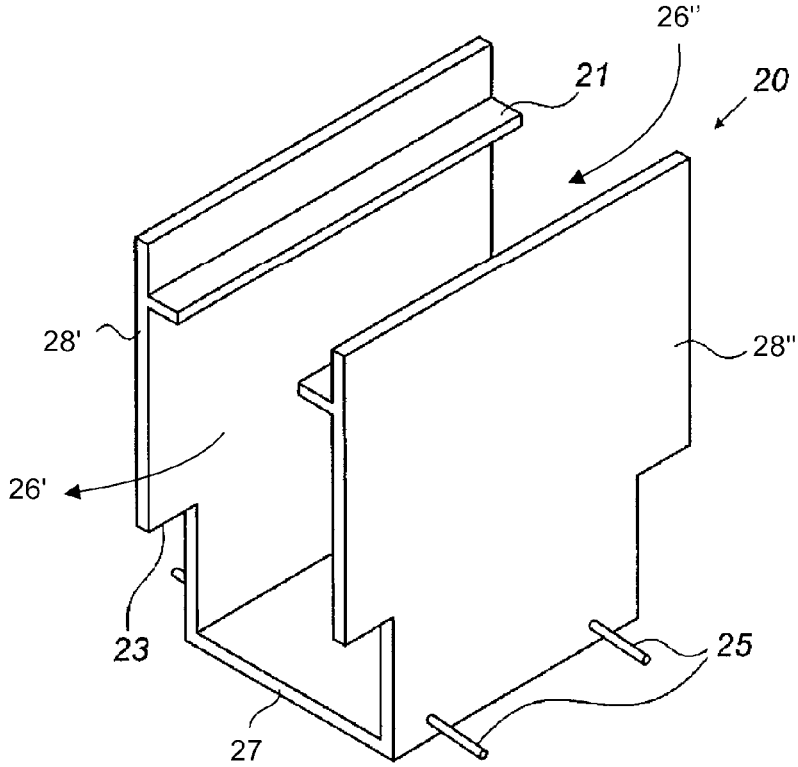
FIG. 5 is a close up perspective view illustration of an empty ammunition magazine, constructed and operative in accordance with an embodiment of the disclosed technique.
Figure 6:
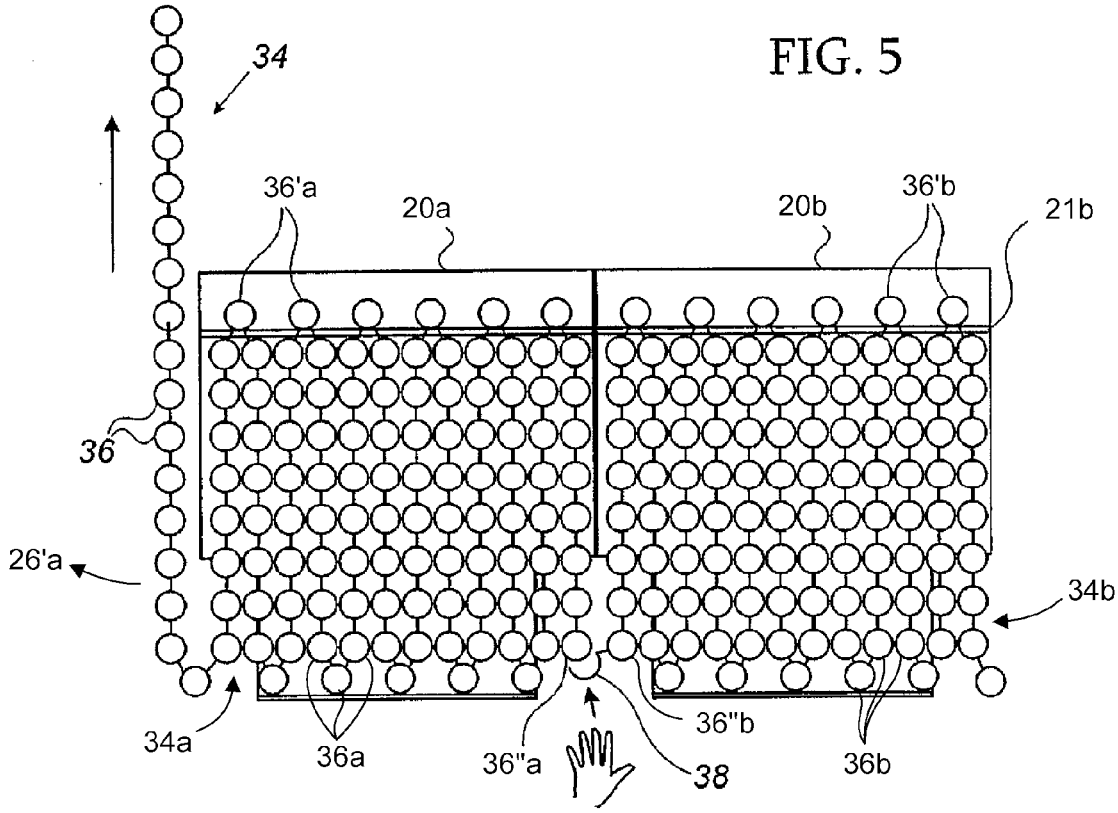
FIG. 6 is a close up cross-sectional view illustration of an arrangement of two consecutively adjacent ammunition magazines, in accordance with an embodiment of the disclosed technique.

Ammunition magazine 20 is designed to enable proper and continuous operation of gun 12. Reference is now made to FIGS. 5 and 6. FIG. 5 is a close up perspective view illustration of an empty ammunition magazine, constructed and operative in accordance with an embodiment of the disclosed technique. FIG. 6 is a close up cross-sectional view illustration of an arrangement of two consecutively adjacent ammunition magazines, in accordance with an embodiment of the disclosed technique. Ammunition magazine 20 is designed to contain ammunition belt 34 or a segment thereof. Ammunition magazine 20 includes two substantially parallel vertical side-walls 28' and 28" opposite one another, and a joining horizontal base 27 that supports and rigidly connects vertical side-wall 28' with vertical side-wall 28" at opposing edges of horizontal base 27, defining a space in which the ammunition belt is situated. Ammunition magazine 20 includes a front opening, indicated by arrow 26', through which the contained segment of ammunition belt 34 (not shown) is pulled towards gun 12 for feeding gun 12 during its operation. The front opening enables the leading end of the contained belt segment to be accessible for continuous feeding of gun 12 or for linking with a trailing end of another segment of ammunition belt 34. Ammunition magazine 20 further includes a rear opening, indicated by arrow 26", in order to enable linking of the trailing end of the ammunition belt segment contained within with the leading end of another segment of ammunition belt 34.

Ammunition belt 34 includes a chain of connected ammunition cartridges 36. When held by ammunition magazine 20, ammunition cartridges 36 are arranged such that the long axis of each ammunition cartridge 36 extends from magazine side-wall 28' to the opposite side-wall 28". Side-wall 28' and side-wall 28" are each formed with a perpendicular ledge 21 projecting from an interior surface of the respective side-wall. Ammunition belt 34 is folded vertically into ammunition magazine 20, such that the top cartridges 36' are supported by ledges 21 (each ledge 21 supporting a respective end of top cartridges 36'), while the portions of ammunition belt 34 between top cartridges 36' are supported by top cartridges 36' and hang downward below ledges 21 in between magazine side-walls 28' and 28". Ledges 21 are formed in a manner that allows a substantially smooth movement of cartridges 36' along ledges 21 while the contained ammunition belt 34 is pulled towards gun 12 during its operation.

An indentation 23 is formed on the bottom corners of each of magazine side-walls 28' and 28". Indentations 23 in magazine side-walls 28' and 28" enable access, from each side of or from below magazine 20, to a leading end and a trailing end of ammunition belt 34 contained in ammunition magazine 20. Indentations 23 may alternatively be formed on horizontal base 27, i.e., magazine side-walls 28' and 28" are formed without an indentation, allowing access only from below magazine 20. Such a configuration may be suitable when magazines 20 may be positioned above hatch 30 or when magazines 20 may be positioned in a raised manner with respect to magazine compartment 16.

Side-walls 28' and 28" may alternatively be coupled by other configurations that rigidly couple side-walls 28' and 28", e.g., via a coupling element at the bottom or at the top of magazine 20. For example, side-walls 28' and 28" may be connected by a plurality of supporting boards disposed therein between at the bottom or top of magazine 20, where the supporting boards extend in a perpendicular or slanted manner with respect to side-walls 28' and 28". Side-walls 28' and 28" may be of different shapes other then rectangular as shown in FIGS. 5 and 6. Ammunition magazine 20 may alternatively include any other type of side supporting structure, for supporting the contained ammunition belt or ledges 21. For example, ammunition magazine 20 may include a plurality of supporting boards at each side of ammunition magazine 20 instead of side-walls 28' and 28".

With reference to FIG. 6, an adjacent and consecutive arrangement of ammunition magazines 20*a* and 20*b* is shown. The leading end of an ammunition belt segment 34*b* contained in ammunition magazine 20*b*, is provided with a hooked link 38. Hooked link 38 is designed to hook over an end cartridge 36"*a* at the trailing end of an ammunition belt segment 34*a* contained in the adjacent ammunition magazine 20*a*. Alternatively, ammunition magazines 20*a* and 20*b* may be arranged such that hooked link 38 is provided at the trailing end of ammunition belt segment 34*a*, and is designed to hook over end cartridge 36"*b* at the leading end of ammunition belt segment 34*b*.

The leading end of ammunition belt segment 34*a* contained in ammunition magazine 20*a* is initially loaded into a chamber of gun 12. When gun 12 is fired, a cartridge 36 that is loaded into the chamber is fired, and the ammunition belt 34 is pulled and advanced so as to load a next cartridge 36*a* of the ammunition belt segment 34*a* into the chamber.

Ammunition magazine 20*b* containing ammunition belt segment 34*b* may be loaded into magazine compartment 16 at a later time. When ammunition magazine 20*b* is raised to a magazine compartment 16 (FIG. 2A) already containing a previous ammunition magazine 20*a*, the raised ammunition magazine 20*b* may be placed consecutively and adjacently to the previous ammunition magazine 20*a* with respect to gun 12, such that the front side of magazine 20*b* is positioned next to the rear side of magazine 20*a*, as shown in FIGS. 2A, 2B and 6. At that point, an operator may reach upward to hook hooked link 38 from the leading end of ammunition belt segment 34*b* contained in raised ammunition magazine 20*b*, which is accessible through the front opening of magazine 20*b* (not indicated), over the trailing end of cartridge 36"*a* of ammunition belt segment 34*a* contained in ammunition magazine 20*a*, which is accessible through the rear opening (not indicated) of magazine 20*a*. As each subsequent ammunition magazine 20 is loaded into magazine compartment 16, the leading end of its ammunition belt 34 or of a segment thereof is connected to the trailing end of the previous ammunition belt 34 or a segment thereof. In this manner, individual belt segments are attached to form a continuous ammunition belt 34, enabling the continuous feeding of machine gun 12.

Ammunition magazines 20*a* and 20*b* may be further arranged in magazine compartment 16 such that ledges 21*a* of magazine 20*a*, positioned proximally with respect to gun 12, and ledges 21*b* of magazine 20*b*, positioned distally with respect to gun 12, are aligned to effectively form continuous rails as shown in FIG. 6. Such an arrangement of magazines 20*a* and 20*b* in magazine compartment 16 allows a substantially smooth movement of top cartridges 36'*b* of belt segment 34*b* from magazine 20*b* into magazine 20*a* when belt segment 34*b* is pulled towards gun 12 during its operation. As ammunition belt segment 34*a* is pulled upward toward gun 12 (FIG. 2A), each top cartridge 36'*a* is pulled laterally along ledges 21*a*. Eventually, top cartridges 36'*a* are pulled laterally off the ends of ledges 21*a* and out of ammunition magazine 20*a* through the front opening of magazine 20*a* (indicated by arrow 26'*a*). At this point, top cartridges 36'*a* and adjacent ammunition cartridges 36*a* may be pulled upward toward gun 12. At some point, ammunition belt segment 34*b*, which is linked to ammunition belt segment 34*a*, is also pulled towards gun 12. Each top cartridge 36'*b* is pulled laterally along ledges 21*b* towards magazine 20*a* and gun 12. At some point, top cartridges 36'*b* are pulled laterally off the ends of ledges 21*b* and out of ammunition magazine 20*b* onto ledges 21*a* of ammunition magazine 20*a*. Top cartridges 36'*b* and the following ammunition cartridges 36*b* are pulled into magazine 20*a* through the front opening of magazine 20*b* (not indicated) and the rear opening of magazine 20*a* (not indicated). Eventually, top cartridges 36'*b* are pulled laterally off the ends of ledges 21*a* and out of ammunition magazine 20*a* upwards toward gun 12. If a third ammunition magazine containing another ammunition belt segment is arranged in the same consecutive and adjacent manner with respect to ammunition magazine 20*b*, and is linked therewith, then the continuous feeding and continuous operation of gun 12 may be prolonged.

Thus, a series of magazines 20 may be arranged in the aforementioned manner to allow continuous and modular feeding and continuous and modular operation of gun 12. The arrangement and alignment of the ledges of ammunition magazines according to the disclosed technique further allows feeding of the machine gun without the need to remove an ammunition magazine, and therefore interrupt the operation of the machine gun, once the ammunition magazine is emptied. In addition, such an arrangement allows empting the most distal magazines in the arrangement before the contained ammunition belts or segments thereof are fed into the machine gun (i.e., the contained ammunition belt is pulled into the adjacent ammunition magazines), therefore allowing replacement of these ammunition magazines with minimal interruption to the operation of the machine gun, or in some embodiments, without any interruption at all.

Magazines 20 may be arranged in accordance with an embodiment of the disclosed technique, manually by an operator, or automatically, by utilizing a magazine positioning mechanism. Such a magazine positioning mechanism may include a rail structure, rigidly affixed to the floor of magazine compartment 16, allowing at least one ammunition magazine 20 to slide along the rail structure, once the magazine 20 is placed in magazine compartment 16 and engaged to the rail structure. The magazine positioning mechanism may include or utilize a magazine retaining means, installed in the vehicle, to allow locking, and therefore retaining, engaged ammunition magazine 20 in a plurality of positions. Magazine 20 may include an engagement fixture, such as extending pins 25, allowing the engagement of ammunition magazine 20 to a magazine positioning mechanism.

Generally, magazine compartment 16 may contain a specific or maximum number of ammunition magazines 20. A combat vehicle in accordance with the disclosed technique may generally allow a specific or maximum number of ammunition magazines to be arranged in such a consecutive and adjacent manner to allow the continuous feeding of a roof mounted machine gun. In particular, once ammunition magazine 20 is empty (i.e., emptied from the ammunition belt segment it contained), the empty ammunition magazine 20 may be removed from magazine compartment 16. Thus, by removing an empty magazine, a replacing ammunition magazine 20, containing another ammunition belt segment, may be placed and arranged in magazine compartment 16, in order to supply further ammunition to be fed into gun 12. Each empty ammunition magazine 20 may be removed immediately, i.e., once emptied, or at some time after it is emptied. Empty ammunition magazines 20 may be removed individually (i.e., one at a time), or multiple empty ammunition magazines may be removed together. For example, combat vehicle 10 may allow an arrangement of three ammunition magazines 20*a*, 20*b* and 20*c* in magazine compartment 16, as shown in FIGS. 2A and 2B, at most. It should be noted that FIGS. 2A and 2B depict magazines 20*a* and 20*b* already arranged in magazine compartment 16 while magazine 20*c* is raised onto compartment 16 by elevator 24. After magazine 20*c* is raised onto magazine compartment 16, an operator arranges magazines 20*a*, 20*b* and 20*c* in accordance with an embodiment of the disclosed technique. It should be further noted that magazines 20*a* and 20*b* may be arranged respective of one another before magazine 20*c* has been raised. Once magazines 20*a*, 20*b* and 20*c* are suitably positioned, and the contained ammunition belts are linked with one another, respectively, the operator operates machine gun 12. Magazine 20*a* will be emptied first, following which magazine 20*b* is emptied, followed by magazine 20*c* being emptied. The operator may continuously remove and replace only magazine 20*c*, while magazines 20*a* and 20*b* are retained in compartment 16, thus shortening the time required to reload gun 12. In this manner, once emptied, magazines 20*a* and 20*b* are effectively used as a buffering storage for temporally holding segments of ammunition belt 34, loaded onto magazine compartment 16, while the segments are pulled towards gun 12 during its operation. [At any time, the operator may remove and replace magazine 20*b* or 20*a* jointly with magazine 20*c*. The removal or replacement of magazines 20 arranged in compartment 16 may be performed jointly, substantially at the same time, or separately.

It should be noted that removing or replacing emptied ammunition magazines and loading filled ammunition magazines with new (unused) ammunition belts, and linking therewith, may be performed during the operation of the machine gun. In an embodiment of a vehicle, including a rotatable turret, such as combat vehicle 10, at least one ammunition magazine 20 disposed in magazine compartment 16 (e.g., FIGS. 1, 2A and 2B) may be replaced during the operation of machine gun 12, if the orientation of rotatable turret 16 is such that hatch 30 can be opened for a sufficient duration to allow safely removing, linking and/or replacing of ammunition magazine 20.

Empty ammunition magazines 20 may be removed manually by an operator in accordance with the disclosed technique through e.g. a hatch (hatch 30 or another hatch designated for removal of magazines 20), or automatically, by a magazine removal mechanism installed in the vehicle. For example, the removal mechanism may include or utilize a lifting mechanism as installed in combat land vehicle 10, such as elevator 24 of FIGS. 2A, 2B and 3, operable to lower an ammunition magazine 20 from magazine compartment 16 into hull 18 of combat vehicle 10. The magazine removal mechanism may further include or utilize a magazine positioning mechanism installed in the vehicle for placing an emptied magazine 20, disposed in magazine compartment 16, onto the lifting mechanism (e.g., lifting platform 22) of elevator 24, for lowering ammunition magazine 20 into the hull region of the vehicle.

According to an embodiment of the disclosed technique, the retaining means of a vehicle in accordance with the disclosed technique may be further operable to retain the arrangement of ammunition magazines 20 intact in magazine compartment 16, particularly during the operation of gun 12. Optionally, at least one empty ammunition magazine 20 may be retained in a fixed manner in magazine compartment 16 of combat land vehicle 10, to be used as a fixed buffering storage for temporally holding ammunition belt 34 or a segment thereof while it is pulled towards gun 12 during its operation.

According to an embodiment of the disclosed technique, an ammunition magazine may be reused by placing a new ammunition belt 34, or a new segment thereof, within the empty used ammunition magazine, and then placing the used magazine back in ammunition compartment 16 in order to feed gun 12 with the new, unused, ammunition belt 34, or a segment thereof, contained within the reused ammunition magazine.

Figure 7:
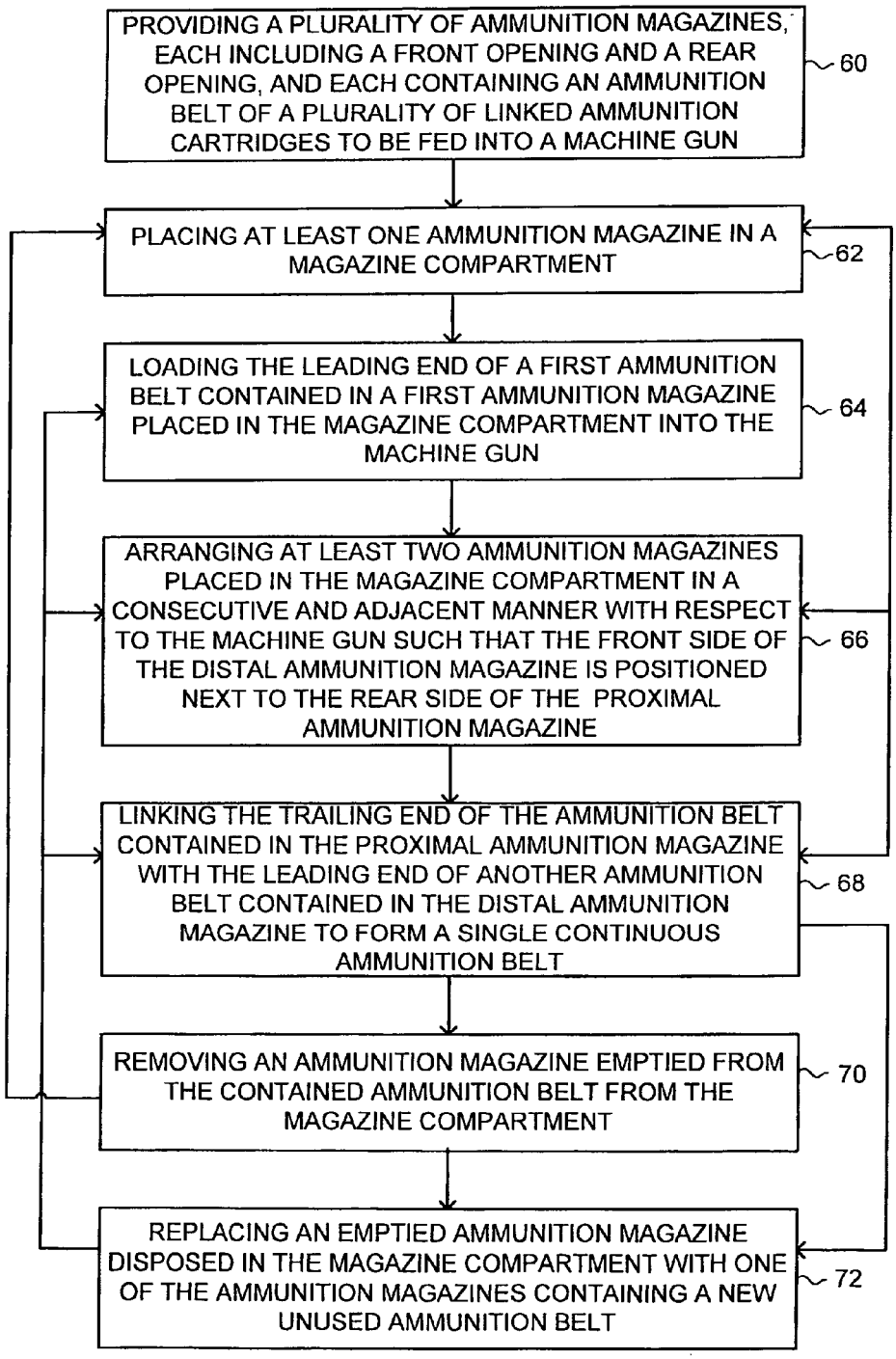
FIG. 7 is a block diagram of a method for feeding of ammunition belts into a machine gun, operative in accordance with an embodiment of the disclosed technique.

Reference is now made to FIG. 7, which is a block diagram of a method for feeding of ammunition belts into a machine gun, operative in accordance with an embodiment of the disclosed technique. The method is further described with reference to FIGS. 1 to 6.

In procedure 60, a plurality of ammunition magazines is provided to a combat vehicle including a machine gun. Each ammunition magazine contains an ammunition belt, which includes a plurality of linked ammunition cartridges to be fed into the machine gun. Each ammunition magazine includes a front opening enabling a leading end of the contained ammunition belt to be accessible for continuous feeding of the machine gun and for linking with a trailing end of another ammunition belt, and a rear opening enabling a trailing end of the contained ammunition belt to be accessible for linking with a leading end of another ammunition belt. With reference to FIG. 5, ammunition magazine 20 includes side-walls 28' and 28" rigidly connected at the bottom of ammunition magazine 20 at opposing edges of joining horizontal base 27. Ammunition magazine 20 further includes a front opening, indicated by arrow 26', through which the leading end of ammunition belt 34 is accessible, and a rear opening, indicated by arrow 26", through which the trailing end of ammunition belt 34 is accessible. The openings may be defined by side-walls 28' and 28" and joining horizontal base 27 as shown in FIG. 5. The providing of a plurality of ammunition magazines 20 may further include providing ledges 21, formed at each side-wall 28' and 28", respectively, and projecting from an interior surface thereof, for supporting the ends of selected cartridges of the contained ammunition belt (as shown in FIG. 6). Accordingly, each of the ammunition belts may be hung over two ledges, which project internally from each respective side of the ammunition magazine. Selected cartridges of each ammunition belt may be supported by the ledges, and each ammunition belt may be vertically folded inside each respective ammunition magazine, such that the folded portions of each respective ammunition belt are hanging from and supported by the selected cartridges.

In procedure 62, at least one ammunition magazine is placed in a magazine compartment of the combat vehicle. The placing of the ammunition magazine may be performed manually by an operator, e.g., by lifting the ammunition magazine through a hatch of the combat vehicle and placing it onto the magazine compartment while the operator is located within a hull region of the vehicle. Alternatively, the placing of the ammunition magazine may be performed automatically by a lifting mechanism of the vehicle. The lifting mechanism may include an elevator, such as elevator 24 as illustrated in FIGS. 2A, 2B and 3, operable to lift ammunition magazines from a hull region located beneath the magazine compartment, as shown in FIG. 1. In such a case, the placing of the ammunition magazine includes placing the ammunition magazine onto a lifting platform of the elevator and operating the elevator to raise the lifting platform into a magazine compartment of the vehicle, enabling the loading of the ammunition belt contained within the magazine into the machine gun. The ammunition magazine may be positioned onto the lifting platform by a single operator, or alternatively, several operators may lift the ammunition magazine a short distance towards the lifting platform.

When ammunition magazine 20 is lifted to a desired position within magazine compartment 16, ammunition magazine 20 may be retained within magazine compartment 16 using retaining means, in a further procedure. The retaining means may be embodied by pins 25 affixed to a bottom edge of ammunition magazine 20, as shown in FIG. 5. Pins 25 may be extended to engage a supporting structure in magazine compartment 16, thereby securing ammunition magazine 20 within magazine compartment 16.

In procedure 64, a leading end (i.e., the proximal end with respect to the machine gun) of the ammunition belt contained by the ammunition magazine placed in the magazine compartment is loaded into the machine gun. The operator may reach upward or climb upward through a hatch of the vehicle in order to load the leading end of the ammunition belt into the machine gun, while still remaining safely inside a hull region of the vehicle or within secure premises thereof and avoiding exposure to the outside of the hull or secure premises and the associated combat risks.

In procedure 66, at least two ammunition magazines disposed in the magazine compartment are arranged in a consecutive and adjacent manner with respect to the machine gun such that the front side of the distal magazine (i.e., distally positioned with respect to gun 12) is positioned next to the rear side of the proximal magazine (i.e., proximally positioned with respect to gun 12). With reference to FIGS. 2A and 2B, magazines 20*a* and 20*b* are arranged consecutively and adjacently with respect to gun 12 such that the front side of magazine 20*b*, which is distally positioned with respect to gun 12, is positioned next to the rear side (not indicated) of magazine 20*a*, which is proximally positioned with respect to gun 12. Such an arrangement allows the linking of ammunition belt segments 34*a* and 34*b*, as indicated in FIG. 6, and will be described in the following procedure. Such an arrangement further allows for smooth continuous feeding of machine gun 12.

The at least two ammunition magazines may be further arranged such that ledges projecting internally from a respective side of each ammunition magazine, for supporting selected cartridges of the contained ammunition cartridges, are aligned. With reference to FIG. 6, magazines 20*a* and 20*b* may be further arranged in magazine compartment 16 such that ledges 21'*a* and 21'*b* and ledges 21"*a* and 21"*b* are aligned to effectively form a continuous rail which allows a substantial smooth movement of ammunition belt segment 36*b* from magazine 20*b* into magazine 20*a* along ledges 21'*b* and 21"*b* and 21'*a* and 21"*a*, accordingly, when ammunition belt segment 36*b* is pulled towards gun 12 during its operation.

The arrangement of at least two ammunition magazines 20 in magazine compartment 16 may be performed manually by an operator or automatically by a magazine positioning mechanism of the vehicle. Such mechanisms are known in the art and may be, for example, a track rigidly fixed to magazine compartment 16 along which magazines 20 slide and therefore can be positioned in a plurality of positions according to the desired arrangement. With reference to FIG. 5, magazine 20 includes pins 25 which may slide along such a track in magazine compartment 16. The arrangement of ammunition magazines 20 according to the disclosed technique may include more than two ammunition magazines 20, as presented in FIGS. 2A and 2B (i.e., an arrangement of three ammunition magazines 20), and may be determined according to relevant criteria, such as the type of ammunition used or the limitations presented by the structure and the features of a vehicle.

When at least two ammunition magazines 20 are positioned in a desired arrangement within magazine compartment 16 in accordance with the disclosed technique, the arrangement of ammunition magazines 20 may be retained within magazine compartment 16 using retaining means, in a further procedure, in order to keep the arrangement intact in magazine compartment 16, especially during the operation of gun 12. The retaining means may be incorporated in the magazine positioning mechanism and may be embodied by pins 25 affixed to a bottom edge of ammunition magazine 20 (FIG. 5). Pins 25 may be extended to engage the magazine positioning mechanism, e.g., a rail structure, in a manner that allows movement of magazine 20 along the rail structure in magazine compartment 16. The magazine positioning mechanism may be further adapted to allow locking of magazines 20, by locking pins 25 of magazine 20, each in at least one position along the rail structure, thereby securing an arrangement of ammunition magazines 20 within magazine compartment 16.

In procedure 68, the trailing end of an ammunition belt, or a segment thereof, contained in a distal ammunition magazine is linked with the leading end of another ammunition belt, or a segment thereof, contained in a proximal ammunition magazine with respect to the machine gun in order to form a single continuous ammunition belt. With reference to FIG. 6, the trailing end of a first ammunition belt 34*a* contained in a first ammunition magazine 20*a* is linked with the leading end of a second ammunition belt 34*b* contained in a second ammunition magazine 20*b*. For example, hooked link 38 of the first cartridge 36"*b* at the leading end of the second ammunition belt 34*b* is hooked onto the last cartridge 36"*a* at the trailing end of first ammunition belt 34*a*. Ammunition magazine 20 may be further provided with indentations 23, which may be formed on the bottom corners of side-walls 28' and 28" of ammunition magazine 20, as shown in FIG. 5. Indentations 23 allow an operator a bottom access (i.e., from below ammunition magazine 20) and a lateral access (i.e., through the sides of ammunition magazine 20) to the leading end and the trailing end of ammunition belt 34 contained within ammunition magazine 20. Thus, with reference to FIG. 6, the operator may link the leading end of ammunition belt 34*b* with the trailing end of ammunition belt 34*a* while ammunition magazines 20*a* and 20*b* are disposed in magazine compartment 16. In order to do so, the operator may reach upward through hatch 30 (illustrated in FIG. 2A) while still remaining safely inside hull 18 and avoid exposure to the outside of a combat vehicle and the associated combat risks.

In procedure 70, an ammunition magazine emptied from the ammunition belt it contained is removed from the magazine compartment. Once an ammunition magazine disposed in the magazine compartment is used by the machine gun (i.e., the ammunition magazine is emptied from the ammunition belt it contained), the used and empty magazine may be removed from the magazine compartment. With reference to FIGS. 2A and 2B, as gun 12 is operated, ammunition belt 34*a* is pulled out from ammunition magazine 20*a*. Once ammunition magazine 20*a* is empty, it may be removed from magazine compartment 16. The removal of a magazine 20 from magazine compartment 16 may be performed manually by the operator reaching for magazine 20 and lowering magazine 20 into hull 18, located beneath magazine compartment 16, through hatch 30, while the operator is safely located within hull 18. The removal may alternatively be performed automatically by a magazine removal mechanism of combat land vehicle 10. The removal may include removing by a dedicated lifting mechanism or by the lifting mechanism used for placing ammunition magazines 20 in magazine compartment 16. The lifting mechanism may include an elevator, e.g. elevator 24 as shown in FIGS. 2A, 2B and 3. The elevator is operated to lower a lifting platform from the magazine compartment to a lower position in the combat vehicle, enabling the removal of a used ammunition magazine. In particular, an operator located within hull 18, which is located beneath magazine compartment 16, operates elevator 24 to lower lifting platform 22 of elevator 24 from magazine compartment 16 to a floor of hull 18. The operator then removes the used ammunition magazine 20 from lifting platform 22. The operator remains safely inside hull 18 and is not exposed to the outside of the combat vehicle and the associated combat risks involved. Magazine 20 may be retained in magazine compartment 16 by retaining means of the combat vehicle, e.g., magazine 20 is engaged to a supporting structure by pins 25. In such a case, prior to lowering lifting platform 22, the operator must disengage magazine 20 in a further procedure. The operator may reach upward through hatch 30 and retract pins 25 of empty ammunition magazine 20, while still remaining safely inside hull 18. The retraction of pins 25 disengages pins 25 from supporting structure in magazine compartment 16, thereby enabling ammunition magazine 20 to be lowered through hatch 30 and into hull 18. The magazine removal mechanism may further include a moving mechanism disposed in magazine compartment 16 in order to move an emptied magazine 20 to a removal position, e.g., above hatch 30. Alternatively, the removal mechanism may utilize or may be integrated in the magazine positioning mechanism of the combat vehicle (or vice versa).

In procedure 72, emptied (i.e., used) ammunition magazine disposed in the magazine compartment of the combat vehicle is replaced with one of a plurality of ammunition magazines containing a new unused ammunition belt, to be fed into the machine gun. Generally, the procedure includes the previous procedures of removing a used emptied ammunition magazine and placing an ammunition magazine containing an ammunition belt (i.e., unused) in the magazine compartment. The replacement of an empty ammunition magazine may be performed manually or automatically or by a combination thereof. The manual replacement may be performed by manually removing the emptied magazine and manually placing an ammunition magazine containing an unused ammunition belt instead of the removed magazine as described in previous procedures. The replacement may be performed automatically by utilizing a lifting mechanism of the combat vehicle. The lifting mechanism may include an elevator such as elevator 24, as shown in FIGS. 2A, 2B and 3. The elevator is operated to lower a lifting platform from the magazine compartment to a lower position in the combat vehicle, enabling the replacement of an empty ammunition magazine with an ammunition magazine containing another, unused, ammunition belt. In particular, an operator located within hull 18, located beneath magazine compartment 16, operates elevator 24 to lower lifting platform 22 from magazine compartment 16 to a floor of hull 18. The operator then removes the empty ammunition magazine 20 from lifting platform 22, and places another ammunition magazine 20 (i.e., containing an unused ammunition belt 34) onto lifting platform 22. The operator may then operate elevator 24 to raise lifting platform 22 back toward magazine compartment 16, as in a previous procedure described hereinabove. The operator remains safely inside hull 18 and is not exposed to the outside of the vehicle and the associated combat risks involved.

The procedure may further include the previous procedure of linking the unused ammunition belt with an ammunition belt contained within an ammunition magazine previously placed in the magazine compartment to allow the continuous feeding of the machine gun. The procedure may additionally include the previous procedure of arranging the replacement magazine in the magazine compartment to form an arrangement of magazines according to the disclosed technique.

The replacement of an ammunition magazine 20 disposed in magazine compartment 16 may be generally performed during the operation of gun 12. In particular, a consecutive and adjacent arrangement of three magazines 20*a*, 20*b* and 20*c* is disposed in magazine compartment 16 (as shown in FIGS. 2A and 2B). Magazine 20*c* may be replaced once it is emptied from the ammunition belt segment 34*c* (not indicated) contained within, and while ammunition belt segment 34*c* is contained within ammunition magazines 20*b* or 20*a* (e.g., by sliding over ledges 21*b* or 21*a* towards gun 12). A replacement magazine 20*c*' (not indicated) for emptied magazine 20*c* is placed and arranged in magazine compartment 16 in a consecutive and adjacent manner with respect to magazine 20*b*, replacing empty magazine 20*c*. A leading end of ammunition belt 34*c*', contained within replacement magazine 20*c*', is linked by the operator with the trailing end of ammunition belt 20*c*, while ammunition belt 20*c* is contained within magazine 20*b* or magazine 20*a*. The trailing end of ammunition belt 20*c* may be in motion as it is pulled towards gun 12 during the operation of gun 12. In such a case, the operation of gun 12 may be slowed down, (e.g., by utilizing computer software, which controls the firing rate of the machine gun), or even stopped, if required, in order to allow the linking of ammunition belt 34*c*' with ammunition belt 34*c*.

The method may include an additional procedure, in which the operator provides instruction signals for operating the lifting mechanism, e.g., elevator 24 as shown in FIGS. 2A, 2B and 3. In particular, with reference to FIGS. 3 and 4, an operator located within hull 18, located beneath magazine compartment 16, operates operator controls 56 to raise lifting platform 22 of elevator 24 toward magazine compartment 16 located in turret 17 above roof 32 of hull 18. Prior to raising lifting platform 22, the operator may verify that current conditions are suitable for raising lifting platform 22. For example, the operator may verify that hatch 30 in roof 32 of hull 18 is open and not blocked. Additionally, the operator may verify that magazine compartment 16 is properly situated with respect to hatch 30, and that there is sufficient space in magazine compartment 16 to accommodate ammunition magazine 20. The operator may further operate operator controls 56 to lower lifting platform 22 of elevator 24 to approach the floor of hull 18, in order to place ammunition magazine 20 onto the lowered lifting platform 22 or in order to replace an empty ammunition magazine 20 positioned on lifting platform 22 with another ammunition magazine 20 containing an unused ammunition belt 34. The operator may then operate operator controls 56 to raise lifting platform 22 of elevator 24 back toward magazine compartment 16, as in the previous procedure described hereinabove. The operator remains safely inside hull 18 and is not exposed to the outside of the combat vehicle and the associated combat risks involved.

The method may include another procedure, in which the operation of a lifting mechanism according to the disclosed technique, for example, elevator 24 as shown in FIGS. 2A, 2B and 3, is controlled in accordance with a defined condition. In particular, with reference to FIGS. 3 and 4, sensors 54 may be provided to sense whether conditions are suitable for raising lifting platform 22. Controller 50 may be configured to generate a visible, audible, or other type of signal to notify the operator whether conditions sensed by sensors 54 are suitable for operation of elevator 24. Controller 50 may also be configured to enable, disable, or limit the operation of elevator 24 in accordance with conditions sensed by sensors 54. When conditions are determined to be suitable, the operator may operate elevator 24 to raise lifting platform 22 until ammunition magazine 20 is raised above hatch 30 and into magazine compartment 16.

The method may further include a procedure in which a leading end of at least one distal ammunition belt, contained in a respective distal ammunition magazine, is linked with a trailing end of a proximal ammunition belt contained in a respective proximal ammunition magazine. The distal ammunition magazine is positioned distally with respect to the machine gun, and the proximal ammunition magazine is positioned proximally with respect to the machine gun. The proximal and distal ammunition magazines are positioned in the proximity of the machine gun and may be placed or arranged in a magazine compartment in accordance with the disclosed technique (as shown in FIGS. 2A and 2B). According to this procedure, each newly placed ammunition magazine (i.e., which may be as an addition to ammunition magazines already disposed in the proximity of the machine gun, or as a replacement for an emptied ammunition magazine that has been removed) may be linked with a proximal ammunition magazine to form a single continuous ammunition belt, to allow for continuous feeding of the machine gun.

It is appreciated that procedures 60, 64 and 68 may be incorporated into two procedures. In a first procedure, a leading end of a first ammunition belt of a plurality of ammunition belts, each having a plurality of ammunition cartridges and contained in a respective ammunition magazine, is loaded into the machine gun through a front opening disposed in the respective first ammunition magazine. In a second procedure, the trailing end of at least the first ammunition belt is linked through a rear opening disposed in the respective first ammunition magazine with the leading end of another of the plurality of ammunition belts through a front opening disposed in the respective ammunition magazine. All of the aforementioned magazine auxiliary mechanisms and means that may be included or incorporated in a combat vehicle in accordance with the disclosed technique, including the lifting mechanism, the retaining means, the magazine positioning mechanism and the magazine removal mechanism, may be embodied by different types of mechanisms, means and various configurations as known in the art, e.g., by adapting the guide or maintaining means of U.S. Pat. No. 3,333,507 mentioned hereinabove or by adapting the conveyor of U.S. Pat. No. 4,466,333 also mentioned hereinabove.

An ammunition magazine in accordance with the disclosed technique may be a disposable or a reusable magazine. In addition, the ammunition magazine may be already provided with an ammunition belt disposed within, or alternatively, the ammunition belts may be provided separately, to be loaded into the ammunition magazines on site (e.g., during the preparations of a combat vehicle for an operation or during the operation thereof). Ammunition magazines in accordance with the disclosed technique may include ammunition belts, or segments thereof, of different types of ammunition (e.g., ammunition of different calibers) linked therewith.

The ammunition magazine, the ammunition loading system, and the method for feeding ammunition belts into a machine gun of the disclosed technique are described hereinabove as used in conjunction with a combat vehicle. According to alternative embodiments, the ammunition magazine, the ammunition loading system and the method for feeding ammunition belts into a machine gun of the disclosed technique may each be used in conjunction with a stationary post (e.g., buildings, posts established in trenches or bunkers, and the like). Accordingly, all relevant components or elements or operations or procedures of the disclosed technique described hereinbelow are equally applicable to an ammunition magazine, ammunition loading system or a method for feeding ammunition belts into a machine gun used on a stationary post, with any suitable modifications where necessary.

An ammunition magazine, an ammunition loading system or a method for feeding ammunition belts into a machine gun according to an embodiment of the disclosed technique may be operative to load or feed a machine gun mounted on a fixed turret (i.e., not necessarily a rotatable turret) or any other suitable mounting structure, or a machine gun which is simply disposed on the ground. The ammunition magazine, the ammunition loading system and the method for feeding ammunition belts into a machine gun may be furthermore operative to load or feed a machine gun disposed in other configurations, i.e., rather than top-mounted, with respect to the vehicle or stationary post.

An ammunition magazine, an ammunition loading system, and a method for feeding ammunition belts into a machine gun, according to embodiments of the disclosed technique may be used with a combat vehicle or a stationary post which includes any type of a platform operative to hold or retain magazines (i.e., a magazine platform) in proximity of a machine gun, rather than a magazine compartment. Such a magazine platform may include the ground (e.g., in the case of a machine gun placed in the proximity of a trench), raised, lowered or leveled surfaces or structures with respect to the machine gun and open (i.e., exposed to the exterior of the vehicle or stationary post or unsecured premises thereof) or closed (e.g., magazine compartment 16 of FIGS. 2A and 2B) structures.

Thus the disclosed technique enables the quick and continuous feeding of a machine gun of a combat vehicle or stationary post, with minimal intervention of an operator and minimal disruption to the operation of the machine gun. Furthermore, the disclosed technique enables a modular feeding, loading and reloading, thus facilitating different configurations of feeding the machine gun and loading and reloading of the ammunition magazines to suit the specific desires, or needs and requirements as dictated by, e.g., a specific machine gun, ammunition, combat vehicle or stationary post, fighting or manning personnel or combat operation. In addition, the disclosed technique enables an operator to load or reload a heavy ammunition magazine into a magazine platform in a top-mounted turret of a combat vehicle or stationary post. A single operator may perform most tasks related to the loading or reloading unassisted and in a minimal period of time, freeing the operator and other occupants of the combat vehicle or stationary post to perform other tasks. An operator need not leave the interior of the hull (secured premises) of the combat vehicle or stationary post during reloading of the magazine platform, avoiding exposure to dangers (e.g., combat risks) outside the combat vehicle or secured premises thereof.

It will be appreciated by persons skilled in the art that the disclosed technique is not limited to what has been particularly shown and described hereinabove.

The invention claimed is:

1. An ammunition magazine for containing an ammunition belt of a plurality of linked ammunition cartridges to be fed into a machine gun, said ammunition magazine comprising:

two parallel vertical side-walls, joined by a horizontal base, wherein the front end of said magazine in between said side-walls is open, enabling a leading end of said ammunition belt to be accessible for continuous feeding of said machine gun and for linking with a trailing end of another ammunition belt, and wherein the rear end of said magazine in between said side-walls is open, enabling a trailing end of said ammunition belt to be accessible for linking with a leading end of another ammunition belt; and two ledges, wherein each of said ledges internally projecting from a respective one of said side-walls of said ammunition magazine and extending substantially from the front end to the rear end along the entirety of the respective side-wall, for supporting selected cartridges of said ammunition cartridges when said ammunition belt is folded vertically inside said ammunition magazine, and when the folded portions of said ammunition belt are hung from and supported by said selected cartridges, wherein selected cartridges are resting on the ledges.

2. The ammunition magazine according to claim 1, wherein said ammunition magazine further comprises:

a first indentation at a bottom front corner of said side-walls, for allowing an operator of said machine gun located at a position below said ammunition magazine access to said leading end of said ammunition belt; and a second indentation at a bottom rear corner of said side-walls, for allowing said operator located at a position below said ammunition magazine access to said trailing end of said ammunition belt.

3. The ammunition magazine according to claim 1, further comprising an engagement fixture for retaining said ammunition magazine in a magazine platform, said fixture adapted to engage a supporting structure in said magazine platform.

4. The ammunition magazine according to claim 3, wherein said engagement fixture comprises extending pins.

5. A method for feeding of ammunition belts into a machine gun, each of said ammunition belts including a plurality of linked ammunition cartridges, the method comprising the procedures of:

providing a plurality of ammunition magazines, each operative for containing a respective one of said ammunition belts, each of said ammunition magazines comprising:

two parallel vertical side-walls, joined by a horizontal base, wherein the front end of said magazine in between said side-walls is open, enabling a leading end of said contained ammunition belt to be accessible for continuous feeding of said machine gun and for linking with a trailing end of another of said ammunition belts, and wherein the rear end of said magazine in between said side-walls is open, enabling a trailing end of said contained ammunition belt to be accessible for linking with a leading end of another of said ammunition belts; and two ledges, each of said ledges internally projection from a respective one of said side-walls of said ammunition magazine and extending substantially from the front end to the rear end along the entirety of the respective side-wall, for supporting selected cartridges of respective said ammunition cartridges, wherein said respective contained ammunition belt is folded vertically inside said ammunition magazine, and wherein the folded portions of said respective belt are hanging from and supported by said selected cartridges, wherein selected cartridges are resting on the ledges;

loading the leading end of a first of said ammunition belts contained in a first respective one of said ammunition magazines into said machine gun; and linking the trailing end of said first ammunition belt contained in said first ammunition magazine with the leading end of a second of said ammunition belts contained in a second respective one of said ammunition magazines.

6. The method according to claim 5, wherein said procedure of linking comprises accessing said trailing end through an indentation formed at a bottom corner of said side-walls of said first ammunition magazine, and accessing said leading end through an indentation formed at a bottom corner of said side-walls of said second ammunition magazine, by an operator located at a position below said first ammunition magazine and said second ammunition magazine.

7. The method according to claim 5, further comprising the procedure of placing at least one of said plurality of ammunition magazines containing one of said ammunition belts in a magazine platform.

8. The method according to claim 7, wherein said procedure of placing comprises automatically placing said at least one ammunition magazine by utilizing a lifting mechanism operable for at least raising said at least one ammunition magazine from a hull region located beneath said magazine platform into said magazine platform.

9. The method according to claim 8, wherein said lifting mechanism comprises an elevator and wherein said procedure of automatically placing comprises the procedures of:

placing said at least one ammunition magazine onto a lifting platform of said elevator; and operating said elevator to raise said lifting platform from said hull region into said magazine platform, enabling the feeding of said contained ammunition belt into said machine gun.

10. The method according to claim 5, further comprising the procedure of arranging at least two ammunition magazines of said plurality of ammunition magazines, disposed in a magazine platform, in a consecutive and adjacent manner with respect to said machine gun, such that the front side of the magazine positioned distally from said machine gun is positioned next to the rear side of the magazine positioned proximally from said machine gun.

11. The method according to claim 8, wherein said procedure of arranging comprises aligning said at least two ammunition magazines such that said ledges of said at least two ammunition magazines are aligned to effectively form two continuous rails allowing a substantially smooth movement of said ammunition belt, contained in said magazine positioned distally from said machine gun, into said magazine positioned proximally from said machine gun.

12. The method according to claim 5, further comprising the procedure of retaining said at least one ammunition magazine placed in said magazine platform intact by using retaining means.

13. The method according to claim 5, further comprising the procedure of removing at least one of said plurality of ammunition magazines disposed in a magazine platform after said ammunition magazine is emptied from said contained ammunition belt by the operation of said machine gun.

14. The method according to claim 13, wherein said procedure of removing comprises automatically removing said at least one ammunition magazine by utilizing a magazine removal mechanism.

15. The method according to claim 14, wherein said magazine removal mechanism comprises a lifting mechanism, said lifting mechanism operable for at least lowering said at least one ammunition magazine from said magazine platform into a hull region located beneath said magazine platform, and wherein said procedure of automatically removing comprises the procedures of:

disposing said emptied ammunition magazine onto a lifting platform of an elevator of said lifting mechanism while said lifting platform is positioned in said magazine platform; and operating said elevator to lower said lifting platform from said magazine platform to said hull region.

16. The method according to claim 5, further comprising the procedure of replacing at least one of said plurality of ammunition magazines, disposed in a magazine platform, after said ammunition magazine is emptied from said contained ammunition belt, with one of said plurality of ammunition magazines, containing an unused one of said ammunition belts.

17. The method according to claim 16, wherein said procedure of replacing comprises automatically replacing said at least one emptied ammunition magazine by utilizing a lifting mechanism, said lifting mechanism operable to raise or lower at least one of said plurality of ammunition magazines between a hull region, located beneath said magazine platform, and said magazine platform.

18. The method according to claim 17, wherein said lifting mechanism comprises an elevator, and wherein said procedure of automatically replacing comprises the procedures of:

disposing said emptied ammunition magazine onto a lifting platform of said elevator while said lifting platform is positioned in said magazine platform;

operating said elevator to lower said lifting platform from said magazine platform into said hull region; and placing said ammunition magazine containing said unused ammunition belt on said lifting platform instead of said empty ammunition magazine, while said lifting platform is positioned within said hull region.

19. The method according to claim 8, further comprising the procedure of controlling the operation of said lifting mechanism in accordance with a defined condition.

20. The method according to claim 8, further comprising the procedure of providing instruction signals by an operator for operating said lifting mechanism, while said operator is located within said hull region.

21. The method according to claim 5, further comprising the procedure of hanging each of said ammunition belts over two ledges internally projecting from each respective side of said plurality of ammunition magazine, wherein said hanging comprises:

supporting selected cartridges of said ammunition belt over said ledges; and folding said ammunition belt vertically inside its respective ammunition magazine, such that the folded portions of said respective belt are hanging from and supported by said selected cartridges.

22. A method for feeding ammunition belts into a machine gun, each of said ammunition belts including a plurality of linked ammunition cartridges, each of said ammunition belts is contained in a respective ammunition magazine of a plurality of ammunition magazines, the method comprising the procedures of:

supporting selected cartridges of each of said plurality of ammunition belts by two ledges, each of said ledges internally projecting from a respective one of said side-walls of said each respective ammunition magazine and extending substantially from the front end to the rear end along the entirety of the respective side-wall;

folding each of said plurality of ammunition belts vertically inside said each respective ammunition magazine, wherein the folded portions of said each ammunition belt are hanging and supported by said selected cartridges, wherein selected cartridges are resting on the ledges;

loading into said machine gun a leading end of a first ammunition belt of said ammunition belts through an open front end between two parallel vertical side-walls of a respective first ammunition magazine of said plurality of ammunition magazines; and linking the trailing end of said first ammunition belt, through an open rear end between said two parallel vertical side-walls of said respective first ammunition magazine, with the leading end of a second ammunition belt of said ammunition belts through an open front end between two parallel vertical side-walls of a respective second ammunition magazine of said plurality of ammunition magazines.

23. The method for feeding ammunition belts into a machine gun according to claim 22, the method further comprising the procedures of:

arranging at least two of said respective ammunition magazines in a consecutive and adjacent manner with respect to said machine gun, such that the front side of the magazine positioned distally from said machine gun is positioned next to the rear side of the magazine positioned proximally from said machine gun; and aligning said at least two ammunition magazines such that said ledges of said at least two ammunition magazines are aligned to effectively form two continuous rails allowing a substantially smooth movement of said ammunition belt, contained in said distal magazine, into said proximal magazine.

* * * * *